United States Patent [19]

Gidseg

[11] Patent Number: 4,776,182

[45] Date of Patent: Oct. 11, 1988

[54] CIRCULATING AIR REFRIGERATOR AND POWER MODULE FOR SAME

[76] Inventor: Edward D. Gidseg, 87-71 Lefferts Blvd., Richmond Hill, N.Y. 11418

[21] Appl. No.: 21,600

[22] Filed: Mar. 2, 1987

Related U.S. Application Data

[63] Continuation of Ser. No. 806,161, Dec. 4, 1985, abandoned.

[51] Int. Cl.[4] ..... F25D 19/00

[52] U.S. Cl. ..... 62/448; 62/289; 62/428

[58] Field of Search ..... 62/289, 428, 429, 506, 62/507, 508, 156, 441, 448, 237

[56] References Cited

U.S. PATENT DOCUMENTS

| | | | |
|---|---|---|---|
| 2,654,227 | 10/1953 | Muffly | 62/429 X |
| 3,230,732 | 1/1966 | Rutishauser et al. | 62/506 X |
| 3,373,578 | 3/1968 | Feeney et al. | 62/289 X |
| 3,486,347 | 12/1969 | Gidseg | 62/187 X |
| 3,623,334 | 11/1971 | Heidorn | 62/156 X |
| 4,304,101 | 12/1981 | Gidseg | 62/187 |
| 4,467,618 | 8/1984 | Gidseg | 62/187 |

*Primary Examiner*—Harry B. Tanner

*Attorney, Agent, or Firm*—Pennie & Edmonds

[57] ABSTRACT

An improved self-defrosting refrigerator and power module therefore, inlcuding a food storage compartment and a refrigeration compartment adjacent and insulatable from the food storage compartment. A refrigeration system of novel design is mounted within the refrigeration power module which includes a compessor, a condensor coil, and evaporator coil, a defroster heater, circulation means for circulating frigid air through the passageways to cool the storage compartment during the refrigeration cycle and means for collecting and exhausting melted frost from the refrigeration power module, which is configured and adapted to prevent the passage of warm air into the module. A method for constructing the novel refrigeration apparatus and improving its cooling efficiency is also disclosed.

25 Claims, 6 Drawing Sheets

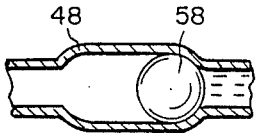
FIG. 4
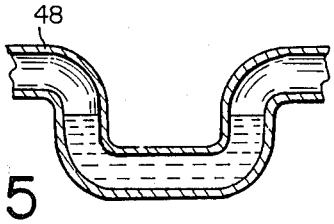
FIG. 5
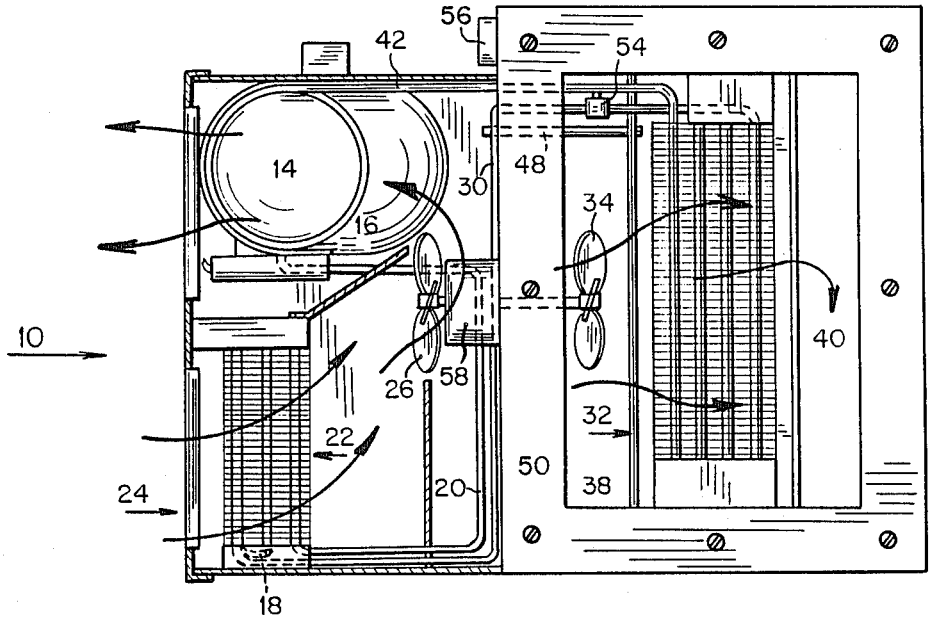
FIG. 6
FIG. 7
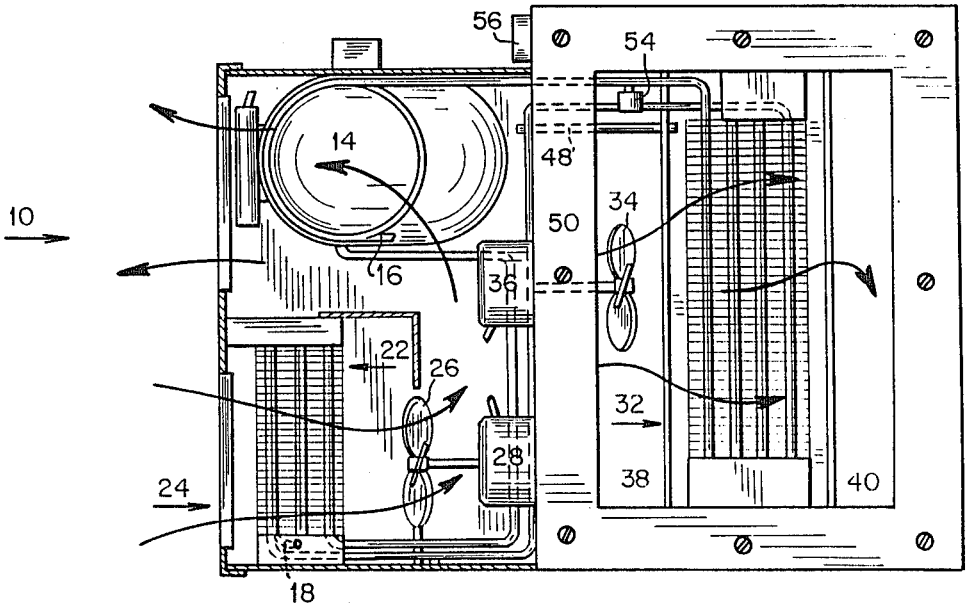

FIG. 9
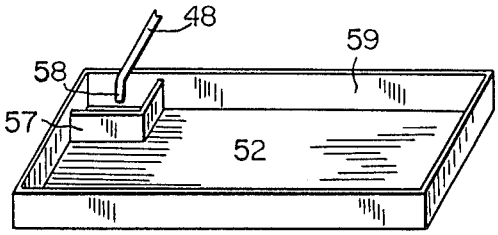
FIG. 10
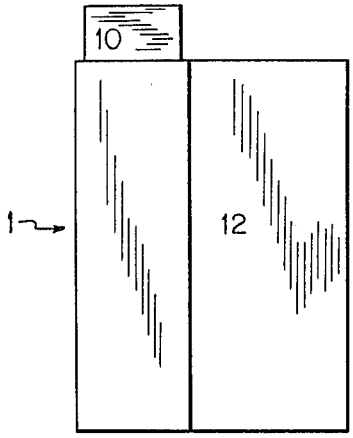
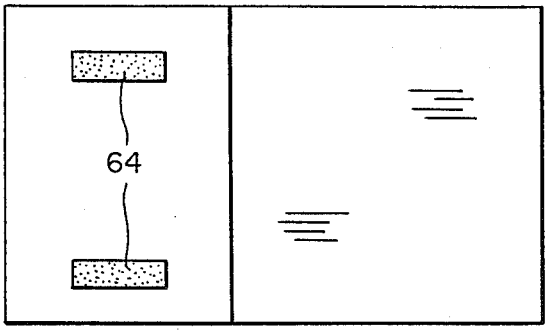
FIG. 14
FIG. 11
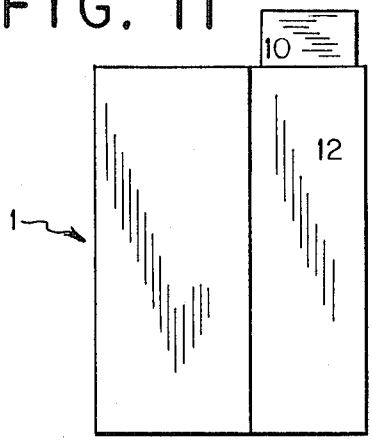
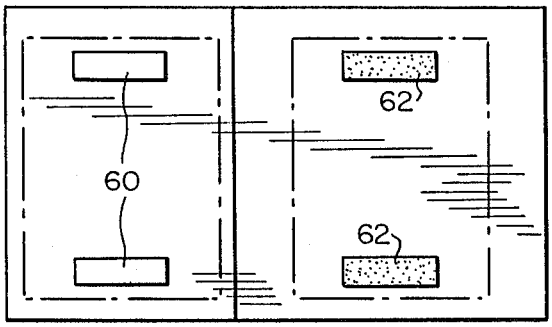
FIG. 13
FIG. 12
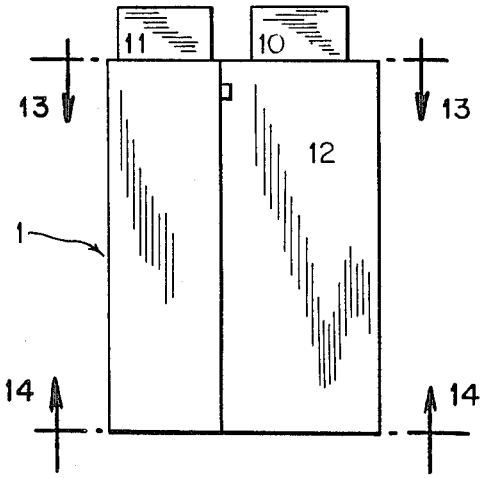

CIRCULATING AIR REFRIGERATOR AND POWER MODULE FOR SAME

This is a continuation of application Ser. No. 806,161 filed Dec. 4, 1985 abandoned.

TECHNICAL FIELD

This invention relates to improvements in power modules for refrigerators of the type which utilize forced circulating refrigerated air to provide cooling in the freezer section and the standard refrigeration section of the refrigerator.

BACKGROUND ART

As used herein, the expression "refrigerator" denotes refrigerators and freezers and combinations thereof. The expression "freezer" section denotes a cooling section in which the temperature is generally maintained at or below the freezing point of water, i.e. 0° C. The expression "standard refrigerator" section or simply "refrigerator" section denotes a cooling storage region, the temperature of which is generally higher than the temperature of the freezer section.

In applicant's U.S. Pat. Nos. 3,421,338 and 3,486,347 there are disclosed several embodiments of a self-defrosting refrigerator of the type disclosed herein wherein refrigerated air is force-circulated through a food storage compartment. The food storage compartment may be in the form of a single freezer or refrigerator compartment or it may be divided into two or more sections, one section being a freezer section and the other section or sections being progressively warmer refrigerator sections.

U.S. Pat. No. 3,486,347 relates to a self-defrosting refrigerator in which the refrigeration system is completely separated from the food storage compartments in modular fashion to thereby permit rapid defrosting of the freezer coils and easy accessibility for servicing mechanical equipment. In one embodiment, the self-defrosting refrigerator includes a food storage compartment divided by a central wall into a freezer section and a refrigerator section. The central wall includes a first opening to permit circulation of chilled air from the freezer section into the refrigerator section and a second opening to permit return circulation of chilled air from the refrigerator section into the freezer section. A refrigerating compartment is adjacent the food storage compartment, the respective compartments being separated by a wall having first and second openings therein which define first and second passageways interconnecting the two compartments.

A refrigeration system, mounted entirely within the refrigerating compartment, includes a compressor, a freezer coil, a defroster heater adjacent the freezer coil supplying heat to melt frost from the freezer coil during a defrosting cycle, a blower adjacent the freezer coil for circulating refrigerated air through the passageways between the first and second openings in the central wall of the first compartment during the refrigeration cycle to cool the freezer section and the refrigerator section.

Applicant has developed an improved power module for use with forced air circulation refrigerators of the type described above. This improved power module operates with greater energy efficiency due to its novel design and its reduced size, which makes it feasible for use with refrigeration cabinets having a width of only eighteen inches. Refrigeration cabinets of this size previously could not be constructed due to the necessity of coupling such cabinets with then existing power modules which exceeded 18" in width. This created a top-heavy combination which provided an unbalanced appearance. Applicants novel 18" wide refrigeration cabinet with its accompanying power module is often commensurate with the space available for a refrigeration cabinet and accompanying power module in a typical urban apartment dwelling.

SUMMARY OF THE INVENTION

The invention relates to improvements in power modules for refrigerators of the type which utilize forced circulating refrigerated air to provide cooling in the freezer section and the standard refrigeration section of a refrigerator.

The improved power module comprises a first compartment substantially surrouned by thermally insulated barrier means which communicates with an inner portion of the refrigeration cabinet containing an evaporator coil and means such as a fan or blower wheel for circulating refrigerated air past the evaporator coil and in contact therewith and thereafter into the refrigerator cabinet in order to cool the space within. The air thenafter returns to the module for recycling.

The propulsion means for the refrigerated air circulating means is located in a second compartment substantially separated from the first compartment by thermally insulated barrier means such as polyurethane foam.

The first compartment further contains defroster heater means adjacent to the evaporator means for supplying heat used to melt frost from the evaporator means during a defrosting cycle. The commencement of this defrosting cycle is regulated by timer means and the cycle proceeds until a temperature sensing device such as a thermostat senses a preset temperature and terminates the current to the defroster heater.

Further, means, such as a conduit for collecting and exhausting melted frost from the first compartment into a second compartment, passes through the thermally insulated barrier means and is configured and dimensioned so as to prevent the flow of warm air from the second compartment into the first compartment. The conduit means is less than six inches in length and may be constructed in a plurality of configurations, such as a "U" shape which is partially filled with water or an elongated cylindrical shape wherein a central portion of the bore is enlarged to permit the insertion of a ball member within.

The second compartment of the module contains a compressor for compressing the refrigerant, which may be dichloridifluoromethane (Freon®12); a condensor coil for receiving and cooling the refrigerant; means for directing the refrigerant from the compressor to the condensor and means, such as a fan or blower wheel, for circulating ambient room air past the condensor and in contact therewith to remove heat from and facilitate the condensation of the refrigerant. The second compartment is configured to minimize the surface area of the first compartment which is contacted by the warmed air which is circulated by the ambient air circulation means.

The second compartment also contains means, such as a capillary tube, for directing the cooled refrigerant from the condensor to the evaporator at a predetermined temperature and pressure, whereby the refrigerant is permitted to expand within the evaporator coil so as to absorb heat from the air directed by the refrigerated air circulating means across the outer surface of the evaporator coil. Finally, the refrigerant is returned from the evaporator to the compressor.

The module as described above may be utilized as a part of an improved force circulating air refrigeration apparatus which comprises a first compartment including a central wall which divides the compartment into a freezer section and a refrigeration section. The central wall has a first opening to permit the circulation of chilled air from the freezer section to the refrigerator section and a second opening to permit the return circulation of chilled air from the refrigerator section to the freezer section.

A second compartment adjacent the first compartment is subdivided into a "cool" section communicating with the interior of the first compartment and a "warm" section. The sections are separated from one another by thermally insulated barrier means such as polyurethane foam.

The "cool" section comprises, as described above, an evaporator coil; refrigerated air circulating means, such as a fan or blower wheel powered by a motor; defroster means adjacent to the evaporator coil for melting frost from the coil, the defrosting cycle being initiated by timer means and terminated by thermostat means; and conduit means for collecting and exhausting the melted frost from the "cool" section of the second compartment into the "warm" section, configured and adapted so as to prevent the passage of warm air into the "cool" section.

The "warm" section further comprises a compressor; a condensor coil; means for directing the refrigerant from the compressor to the condensor coil; means for circulating ambient room air past and over the condensor coil; means, such as a capillary tube, for directing the refrigerant from the condensor coil to an evaporator coil at a predetermined temperature and pressure, and means for returning the refrigerant to the compressor.

In one embodiment of the invention, the first and second compartments described above are of modular construction and may be separated one from another.

In a further embodiment of the invention, the power module, described above as the second compartment, may be coupled with a first compartment having a width of only about 17 inches. This compartment comprises a substantially vertically standing refrigeration cabinet constructed of a top member, a bottom member and two pairs of opposed vertical side members The cabinet also has access means to its interior portion on at least one vertical side.

The first compartment of the refrigeration apparatus described above may also be separated into an upper freezer section and a lower refrigerator section by divider means such as a removable shelf.

A further object of the invention is to provide a method for improving the cooling efficiency of a power module for use in communication with a forced circulating air refrigeration cabinet wherein the power module comprises a "warm" compartment; a "cool" compartment separated from the "warm" compartment by thermally insulated barrier means such as polyurethane foam; first motor driven means for circulating air through the refrigeration cabinet, said means being located in the "cool" compartment; means connecting the "warm" and the "cool" compartments for the removal of melted frost; and second motor driven means for circulating air through the "warm" compartment to evaporate the melted frost.

The method comprises locating the first and second motor drive means of the circulating air means in the warm compartment, on the outer surface of the thermally insulated barrier means; configuring the connecting means to prevent the movement of warm air from the warm compartment to the cool compartment; and directing the circulating air in the "warm" compartment so as to minimize contact of the air with the outer portion of the "cool" compartment, in order to promote more efficient cooling in the "cool" compartment while minimizing the energy required to obtain said cooling.

A further object is to describe a method for constructing the power module described above, which method comprises: locating the first compartment substantially rearwardly upon the top member to the refrigeration cabinet with respect to the access means; locating the second compartment substantially forwardly upon said top member with respect to the access means; substantially separating the first and second compartment by means of a thermal barrier; isolating a first and second drive means for the refrigerated air and ambient air circulation means respectively on the outer surface of the thermal barrier in the second compartment; configuring the means for the collection and exhaustion of melted frost so as to prevent the flow of warm air from the second compartment into the first compartment and directing and circulating the air flow in the second compartment so as to minimize contact with the outer insulated portion of the first compartment.

A method of constructing a forced circulating air refrigeration apparatus is also disclosed which comprises: constructing a first compartment comprising a substantially vertically standing refrigeration cabinet, constructed of a top member, a bottom member and two pairs of opposed vertical side members, the refrigeration cabinet having access to an interior portion of the cabinet on at least one vertical side member. The cabinet further includes a central wall which divides it into a freezer section and a refrigeration section, the wall having an opening to permit the circulation of chilled air from the refrigerator section to the freezer section.

The method further comprises constructing a second compartment adjacent the first compartment. The second compartment is subdivided into a "cool" section and a "warm" section, divided by thermally insulated barrier means, and located substantially rearwardly and substantially forwardly, respectively, upon the top member of the refrigeration cabinet with respect to the access means.

A first drive means for the refrigerated air circulation means and a second drive means for the ambient air circulation means are isolated on the outer surface of the thermally insulated barrier means in the "warm" section. Further, the means for the collection and exhaustion of melted frost are configured so as to prevent the flow of warm air from the "warm" section into the "cool" section. Finally, the air in the "warm" section must be directed and circulated so as to minimize contact with the outer insulated portion of the "cool" section.

BRIEF DESCRIPTION OF THE DRAWINGS

FIG. 4 is a cross sectional view of one embodiment for the drain conduit utilizing a rounded ball member installed in a widened portion of the conduit bore;

FIG. 5 illustrates a cross sectional view of a second embodiment for the drain conduit in which the base of the U-shaped trap is filled with a liquid;

FIG. 6 is a top plan view of an alternate embodiment for the power module utilizing one motor, located outside the insulated portion of the module, to turn both fans; and FIG. 7 is a top plan view of a further embodiment for the power module, illustrating the use of two fan motors, both of which are located outside the insulated portion of the module.

FIG. 9 illustrates a water collection and evaporation area created by constructing a dam in one corner of the condensor pan adjacent to the effluent end of the drain conduit;

FIGS. 10–11 are schematic representations illustrating the use of the power module of the invention with refrigeration cabinets having left and right-handed freezers respectively;

FIG. 12 illustrates a refrigerator-freezer combination which utilizes two power modules to provide back-up and/or supplemental cooling;

FIG. 13 is a cross-sectional partial view taken along lines 13—13 of FIG. 12; and FIG. 14 is a cross-sectional partial view taken along lines 14—14 of FIG. 12.

DETAILED DESCRIPTION OF THE PREFERRED EMBODIMENTS

Figure 1:
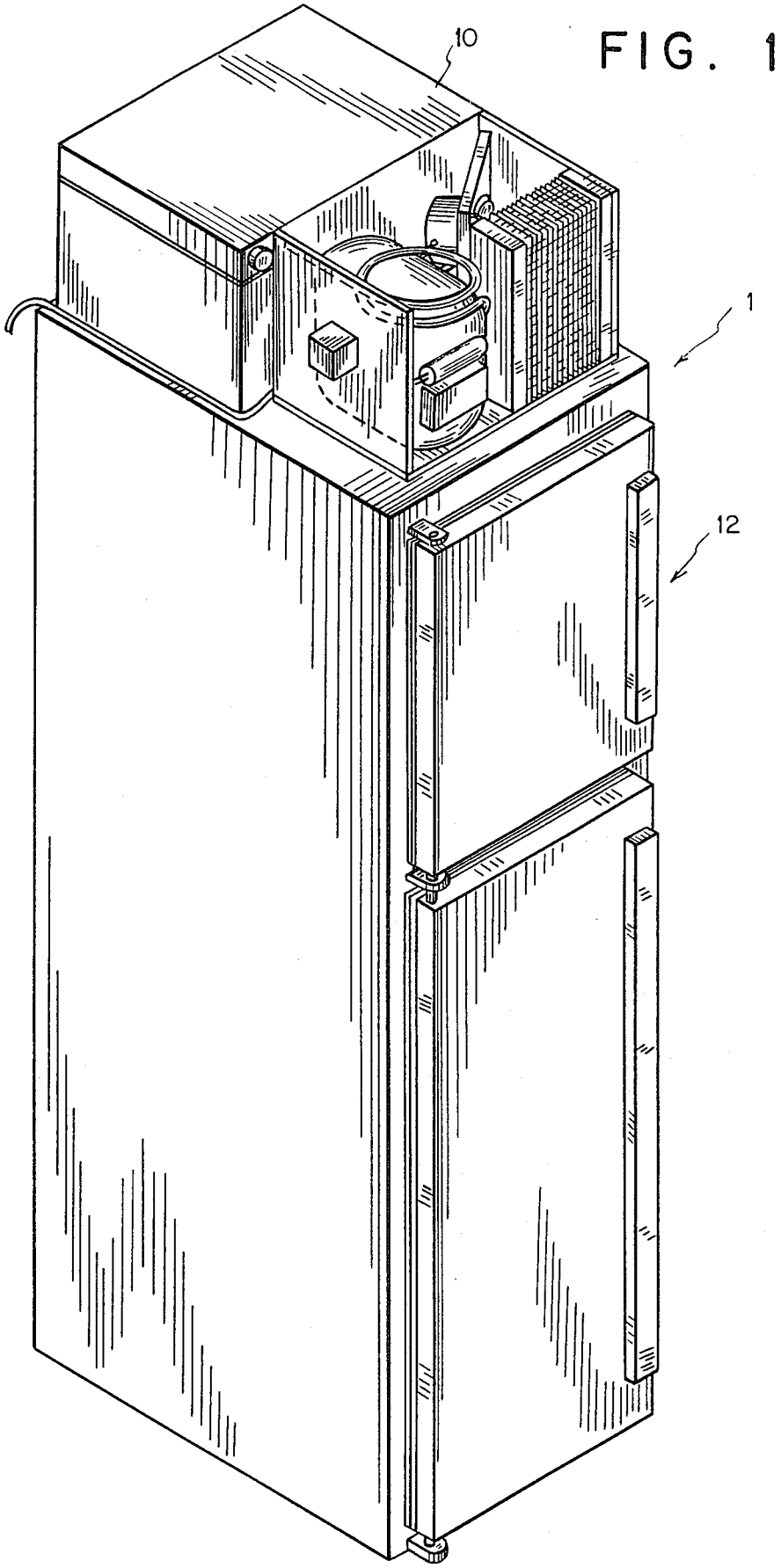
FIG. 1 is a top front and left side perspective view of a refrigerator utilizing the refrigeration power module constructed according to the invention.

Referring to FIG. 1 there is illustrated refrigerator 1 having refrigeration module 10 constructed according to the invention and installed on top of, and in connection with, insulated refrigeration cabinet 12. This Fig. illustrates clearly the exterior appearance of the module 10.

Figure 2:
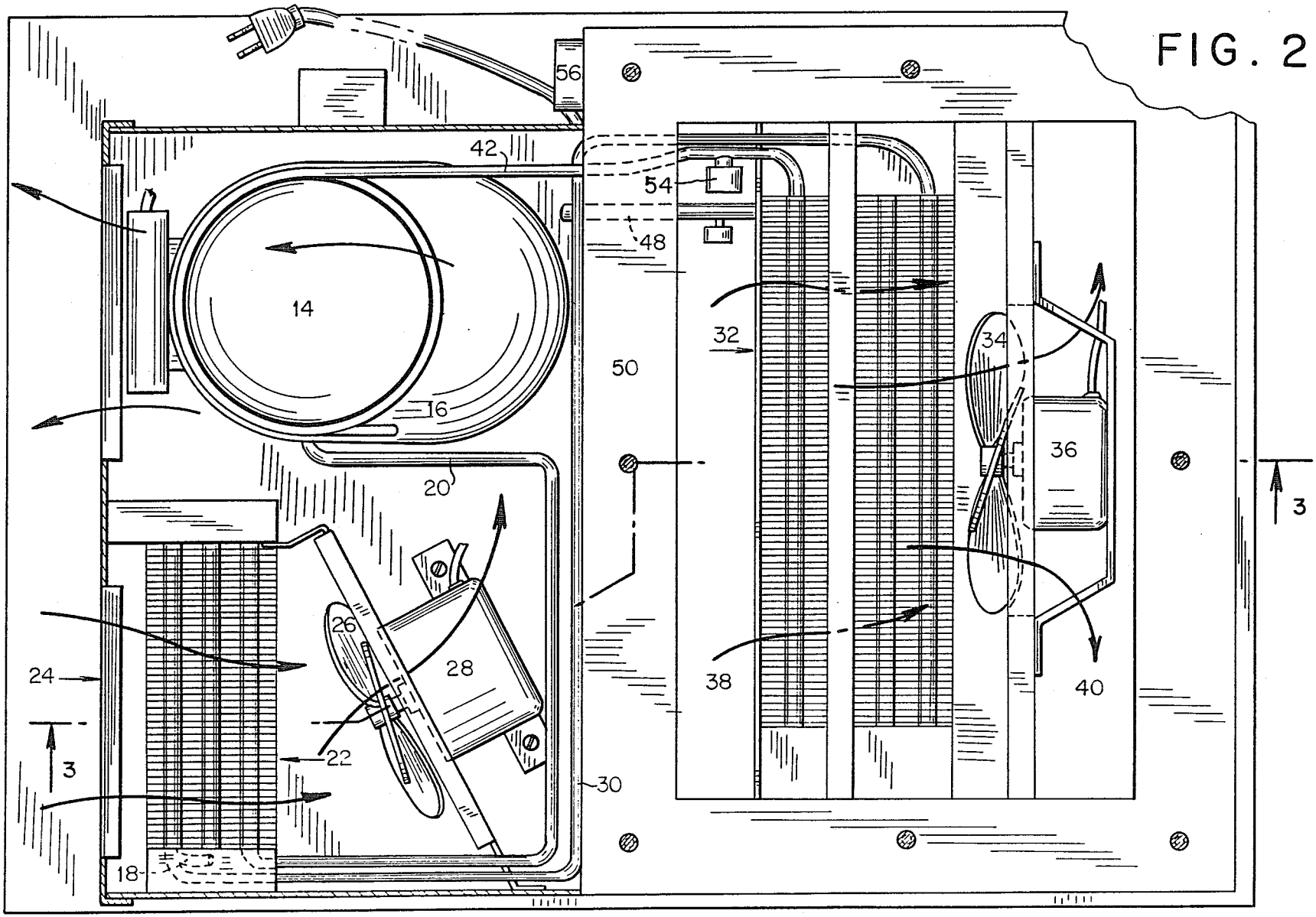
FIG. 2 is a top plan view of the interior of the refrigeration power module of the invention.

FIG. 2 is a top plan view of refrigeration module 10 with the cover removed. Gaseous refrigerant (e.g. Freon®12, also known as dichlorodifluoromethane) is placed into the refrigeration system at two locations. These are: fill tube 16, which charges that portion of the refrigeration line subject to "suction" from compressor 14 and fill tube 18, used for charging that portion of the system on the "pressure" side of condensor coil 22. Fill tube 16 is the primary route for the introduction of refrigerant into the system because the "suction" provided by compressor 14 facilitates the absorption of the refrigerant into compressor 14 thus assuring that the system is fully charged.

In operation, compressor 14 compresses the gaseous refrigerant by means of a known electrically operated cam and piston mechanism (not shown), thus forcing gaseous refrigerant through line 20 into and through the condensor coil 22. As the refrigerant travels through the interior of the coil, room air is drawn into module 10 through louvres 24 by the action of condensor fan 26, powered by motor 28. The relatively cool room air absorbs the heat from the compressed refrigerant, which is under high temperature and pressure due to the effect produced by the action of compressor 14. This serves to cool the vapor within the condensor coil 22, causing the refrigerant to condense into a transitional liquid phase, with a concurrent reduction in pressure.

The refrigerant then leaves condensor coil 22 through capillary tube 30, the length and diameter of which are fixed so as to permit only predetermined amounts of refrigerant through the tube. Thus, capillary tube 20 functions as an expansion valve, the size differential of which causes a precisely predetermined increase in pressure along the length of tube 30.

As the refrigerant exits capillary tube 30 and circulates through the fins of evaporator coil 32, there is a rapid drop in the temperature of the liquid refrigerant (e.g. from about 120° F. to about −5° to −20° F.), as well as a rapid decrease in the vapor pressure of the refrigerant. This leads to a rapid expansion of the refrigerant with a consequent transition from the liquid phase to the vapor phase, and a concurrent cooling of the atmosphere surrounding these fins.

Further, as the refrigerant circulates through evaporator coil 32, evaporator fan 34, powered by motor 36, draws air entering power module 10 through entry duct 38 from refrigeration cabinet 12 (not shown), and across the exterior surface of the coil. This air is cooled as it passes over the fins due to the absorption of heat by the refrigerant and it is then expelled back into refrigeration cabinet 12 through discharge duct 40.

In an alternate embodiment of this arrangement, the air circulation device, such as a fan or a blower wheel, may be located within entry duct 38 or discharge duct 40 (not shown). This alternative placement would be equally as effective as the preferred embodiment described above in drawing air from refrigeration cabinet 12 for cooling by evaporator coil 32. If the circulation device were to be located in entry duct 38, the air would then be pushed over evaporator coil 32, whereas the placement of such a device in exhaust duct 40 would result in the air being pulled across the surface of evaporator coil 32.

The now warmed refrigerant leaves evaporator coil 32 through line 42 at a low pressure due to the "suction" effect of compressor 14 and is directed once again into compressor 14 wherein the above-described cycle is repeated.

Referring now to FIG. 2 in conjunction with FIG. 3, the defrosting cycle will be described. During the defrosting cycle, in which the frost from evaporator coil 32 is removed, defroster heater 44, located beneath evaporator coil 32, is heated to melt the frost. The melted frost then drips into evaporator pan 46 located below defroster heater 44. The resultant moisture then travels through drain conduit 48, through insulated wall 50, into condensor pan 52. In the preferred embodiment, pan 52 is actually the base of the front frame section of module 10. In an alternate embodiment, an actual pan member may be installed for the collection and evaporation of the liquid frost This liquid then evaporates into the atmosphere as water vapor through louvres 24.

Because of the unique placement of defroster heater 44, i.e. in close proximity to both evaporator coil 32 and drain conduit 48, the melted frost does not freeze in evaporator pan 46 or drain conduit 48 during the defrosting cycle, but rather remains in the liquid state. In contrast, defroster systems utilized in the prior art use separate heaters to prevent freezing of this liquid within the evaporator pan and the drain tube. Applicant's defroster apparatus thereby achieves this desired end with much greater efficiency due to a reduction in the amount of heating elements used, as well as a reduction in the residual heat produced by the system, in comparison with the apparatus of the prior art.

A further advantage provided by applicant's novel design is the elimination of the relatively lengthy conventional tubes utilized in prior art systems to transport melted frost to remote locations. The drain conduit 48 of the present invention is less than 6" in length, whereas the length of the drain tube found in many prior art systems is measured in feet because the tube must be run from the cooling apparatus, behind the refrigeration cabinet 12 to a defroster pan underneath refrigerator 1, where evaporation of the melted frost subsequently occurs.

The defrosting cycle is controlled by timer 56 which is set to initiate the cycle at the expiration of a preselected time period. As the atmosphere surrounding evaporator coil 32 reaches a preselected temperature, this temperature is sensed by thermostat 54 which terminates the defrost cycle by cutting the power to defroster heater 44, thus reinitiating the refrigeration cycle.

Figure 3:
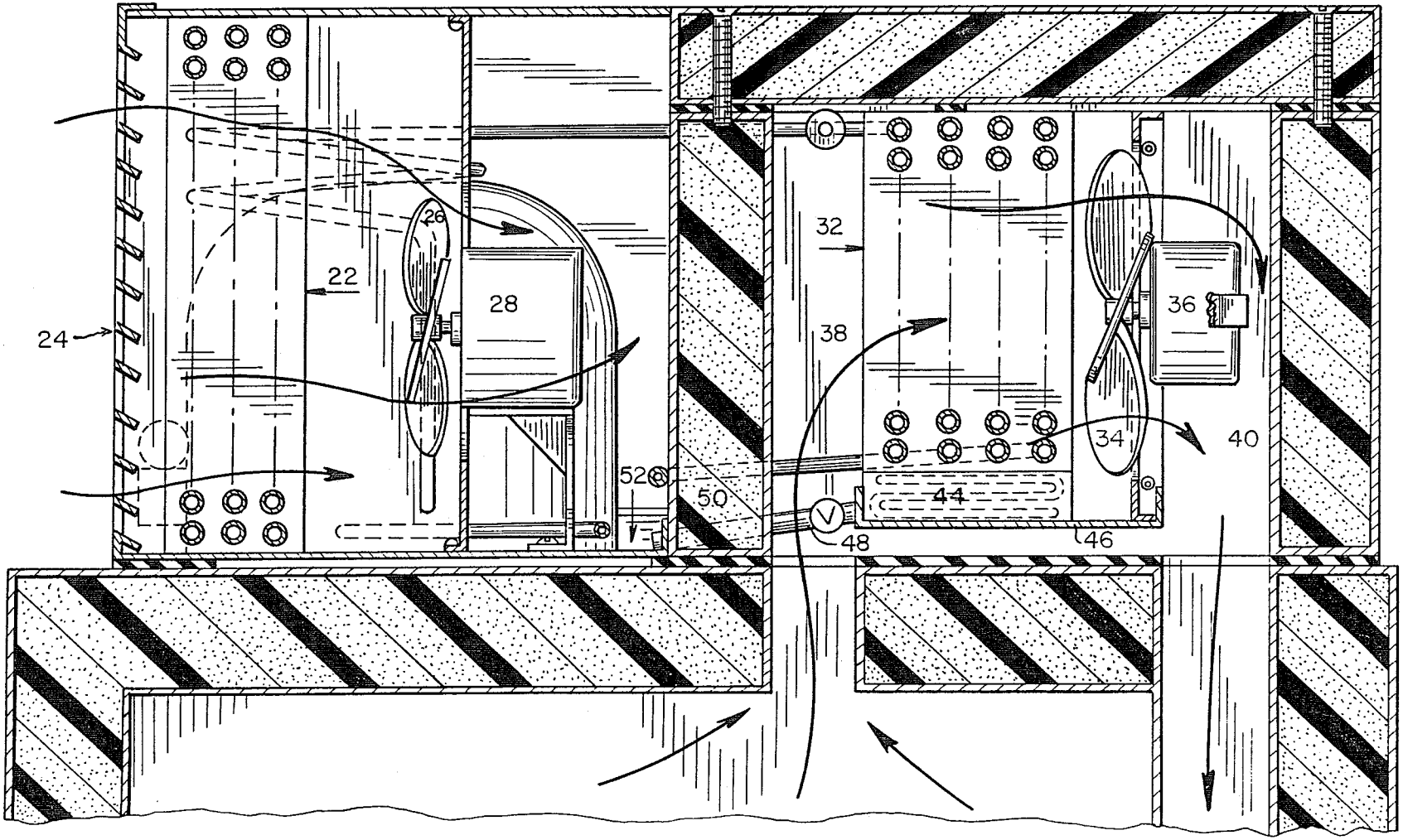
FIG. 3 is a view partially in cross-section, of the refrigeration power module taken along lines 3—3 of FIG. 2.

FIG. 3 is a cross-sectional view of power module 10 taken generally along lines 3—3 of FIG. 2. Referring now to FIG. 3, this view more clearly illustrates how spent refrigerated air, rising from refrigeration compartment 12, passes into power module 10 through entry duct 38. This air is then cooled as it is drawn across evaporator coil 32 by evaporator fan 26, after which it is reintroduced as refrigerated air into either or both of the compartments in refrigeration cabinet 12 through discharge duct 40.

Further, in FIG. 3 the orientation of evaporator pan 46 in an elevated position with respect to condensor pan 52 is clearly shown. As previously noted, the warmth provided by defroster heater 44 melts any frost which forms on evaporator coil 32 during the defrost cycle, which then drips downwardly into evaporator pan 46. As it is collected, this liquid runs downhill through drain conduit 48, passig through insulated wall 50, and enters condensor pan 52. This liquid is then evaporated by the heat produced within this portion of module 10, and the resultant water vapor is absorbed into air entering the module through louvres 24 due to the action of condensor fan 26 powered by motor 28.

FIGS. 4 and 5 illustrate the preferred embodiments of drain conduit 48, also shown in FIGS. 2 and 3. If conduit 48, depicted in FIGS. 2 and 3, were to be constructed as an open tubular member, such an arrangement would then allow the passage of warm air into the insulated section of the module which contains evaporator coil 32, thus depressing its refrigeration capabilities and reducing the efficiency of the system Therefore, the embodiments depicted in FIGS. 4 and 5 are intended to prohibit the passage of warm air through conduit 48 and are thus preferred.

FIG. 4 depicts the insertion of a rounded ball member 58 into the expanded bore of conduit 48, which permits the flow of defrosted liquid in one direction but which prohibits a return flow of warm air into the refrigerating portion of module 10.

FIG. 5 illustrates a second preferred embodiment of conduit 48 which will also perform the function described above. In this embodiment, conduit 48 includes a U-shaped bend as shown. The base portion of this U-bend remains filled with water at all times during the refrigeration cycle. The base of the "U" must be long enough and deep enought to prevent the increase in pressure in the interior of module 10, caused by closing the door of refrigeration cabinet 12, from forcing the water out of conduit 48. This would defeat the purpose of such an arrangement by allowing the passage of warm air into the insulated section of module 10.

The water within the base of the U-shaped bend may freeze into ice during the refrigeration cycle and this ice prevents the movement of warm air through conduit 48. During the defrosting process, the ice melts and the resultant water travels through conduit 48 into condensor pan 52 along with water resulting from the defrosting process. When the defrosting cycle is terminated, the water once again freezes into a plug upon the recommencement of the refrigeration process. Even if the water does not freeze, the presence of the liquid water in conduit 48 prevents the movement of warm air therethrough.

Thus it can be seen as noted hereinabove that the embodiments depicted in FIGS. 4 and 5 are effective in preventing the passage of warm air from the relatively hot "compressor" section to the relatively cool "refrigeration" section of module 10.

A third preferred embodiment illustrated in FIG. 9 relates to the provision of a "dam" construction to create a "lake" or water collection area in one corner of condensor pan 52. The conduit 48 outlet, which terminates at the base of dam 54, therefore becomes immersed in water which flows therefrom during the defrosting cycle. This prevents the passage of warm air through conduit 48 into the insulated section of power module 10. The walls of dam 57 must be higher than the outlet of drain conduit 48 which directs the water into the collection area. The walls of the dam are constructed lower than the walls 59 of the surrounding pan 52 so that any overflow may be constrained within the confines of pan 52. The dam 57, which receives the preponderance of the melted frost, is thereby assured of containing adequate water to cover the opening of conduit 48. Further, the lip 58 of conduit 48 is preferably cut on a slight diagonal bias to minimize the possibility of a flow restriction due to the end of the conduit 48 resting flush against the pan floor behind dam 57, thus providing a declogging feature.

FIG. 6 depicts an alternate embodiment of module 10 of FIGS. 2 and 3. This embodiment requires only one motor 58, located outside insulated wall 50 and inside the comparatively warm "compressor" section, to rotate condensor fan 26 as well as evaporator fan 34. Evaporator fan 34 serves to propel spent refrigerated air, which enters module 10 from refrigeration compartment 12 through entry duct 38, across evaporator coil 32 and back into refrigeration comparatment 12 through discharge duct 40. Depending upon its orientation, condensor fan 26 sucks or blows exterior air through louvres 24 across condenser coil 22, which air then absorbs the moisture from condenser pan 52, leading to its expulsion from module 10.

FIG. 7 illustrates a somewhat similar embodiment wherein fans 26, 34 are each powered by a separate motor, both motors being located outside insulated wall 50 and inside the warmer "compressor" section of module 10. It can be seen that the motors, which generate heat, are advantageously located away from evaporator coil 32 and thus, any heat generated by these motors will not interfere with the efficiency of the refrigeration process. Alternately, fans 26, 34, may be rotated using a single motor directly connected to one fan with, for example, a belt and pulley arrangement to turn the other fan.

Figure 8:
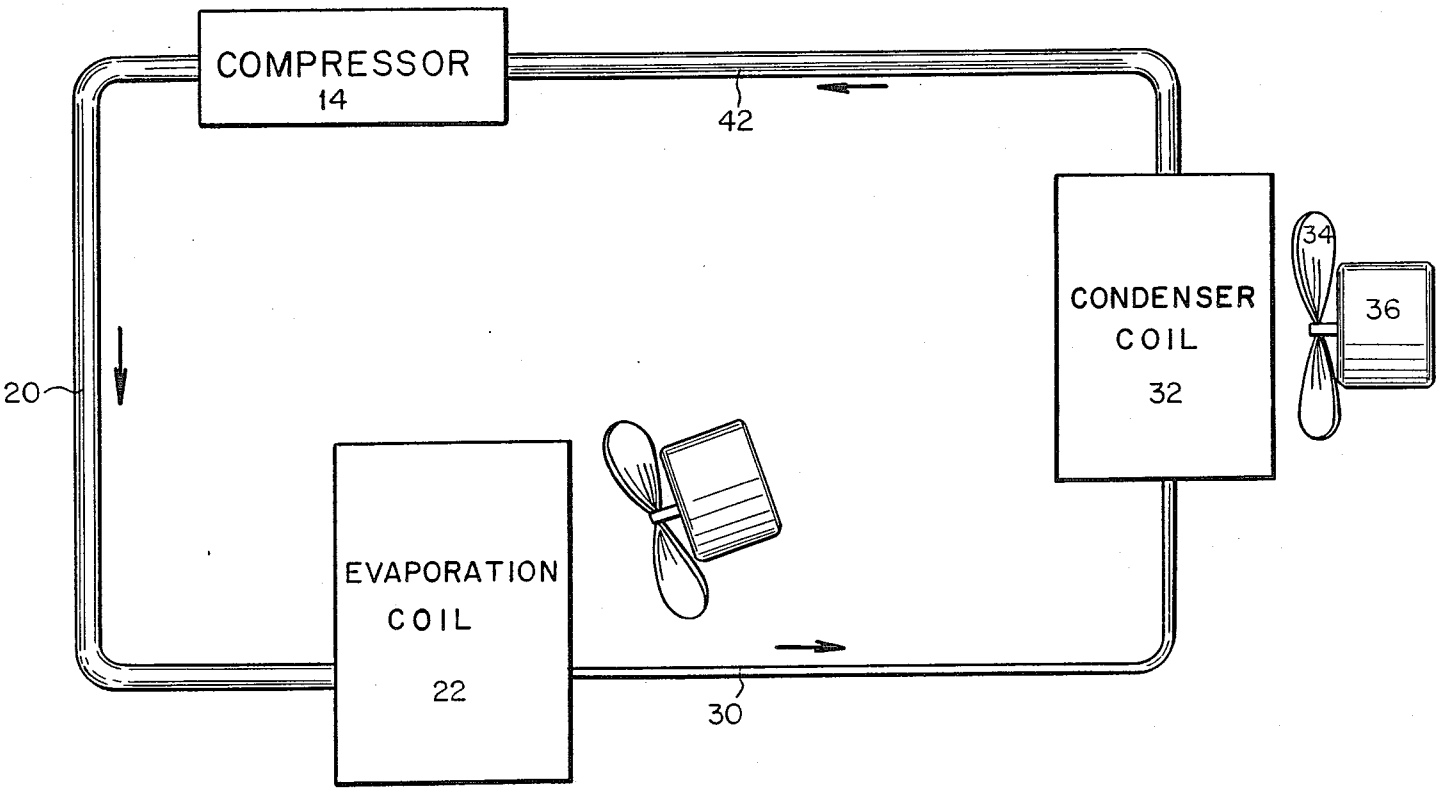
FIG. 8 is a schematic representation illustrating the flow of refrigerant through the refrigeration system of the module.

FIG. 8 provides a schematic representation illustrating the flow of refrigerant through the refrigeration system of module 10.

The advantage of the present invention over the refrigeration systems utilized in the prior art resides in the increased cooling efficiency of module 10, concomitant with a reduction in the surface area of the module being exposed to air having a high thermal coefficient. This reduction in surface area is due to a re-orientation of the air flow within module 10 which reduces the amount of thermal energy transferred through the metal surfaces of the module.

The efficiency of the system is further increased by a reduction in the size of the condenser fan/condensor coil apparatus 26, 22, as well as the evaporator fan and evaporator coil 34, 32, which is now possible because of the shortened air path utilized in applicant's module. This reduction in size correspondingly permits a reduction in the amount of energy necessary to operate the refrigeration system.

Refrigeration power modules constructed according to applicant's invention may thus be reduced in size to a width of only about 17 inches, or less if desired, while still providing enough energy to cool a refrigerator or refrigerator-freezer combination of up to 48 or more inches in width. This minimally sized module 10 may alternately be utilized with refrigeration cabinets which are even smaller than 17" wherein the refrigerated air is circulated between the module 10 and the refrigerator portion of cabinet 12 by means of an angled exterior duct connecting the two. A preferred application for the present invention, however, is to utilize such 17" modules to cool refrigeration cabinets of equal width, which dimension is often commensurate with the space available for a refrigerator cabinet and accompanying power module in a typical urban apartment. The height and depth of refrigeration cabinets utilizing the module disclosed herein may also be varied during the construction of the unit in order to meet the varying needs of the consumers who purchase them.

Alternatively, consumers with sufficient space may choose to place a plurality of narrow refrigeration units in series, each powered by its own power module. This enables the consumer to dedicate individual modules to different uses and obviates the necessity of mixing various categories of stored foodstuffs in a single refrigeration apparatus.

As illustrated in FIG. 12 applicant's novel engineering design now allows, for the first time, the construction of a refrigerator-freezer combination 1 having a width of as little as 34" wherein each of the separate compartments are located within a single cabinet, with the power for each compartment being provided by separate modules 10, 11. The second power module 11 may act as a back-up power source for the apparatus in the event the primary source 10 fails to operate. This allows the operation of one power module while the other is held in reserve or both may be operated at once to provide an additional cooling capacity. This is especially useful in applications involving critical cooling needs, such as in the refrigeration of medicines and other pharmaceuticals.

Further, when the cooling requirements for a particular application do not exceed about 32° F., the defroster system may be entirely dispensed with in order to further streamline the apparatus.

By providing connecting ports or openings, which may be either manually or automatically opened by a thermostat located between the refrigeration and freezer compartments, if a module failure should occur, or the door of refrigeration cabinet 12 is left ajar, the second operating module can be used to supply supplemental cooling to both compartments, by circulating refrigerated air through the connecting ports, thus providing a redundancy of protection heretofore unavailable in such a commercially manufactured refrigeration apparatus.

The refrigeration power module 10, as developed by applicant, may be installed in various locations on refrigeration cabinet 12. With relatively minor modifications during the manufacturing process, the air flowing into and out of the insulated portion of module 10 may be directed upward in modules designed to be installed beneath the refrigeration cabinet 12 and sideways for modules designed to be installed on a vertical planar surface, such as the front, back or side of a refrigeration cabinet. Applicant's invention may therefore even be utilized as a portable refrigeration system which, because of its reduced size and weight, may be removed for repair and/or replaced by a single service representative working alone.

Finally, as illustrated in FIGS. 10–11 and 13–14, an important manufacturing breakthrough developed by the applicant permits, for the first time, the construction of either left side (FIG. 10) or right side (FIG. 11) freezer portions in a side-by-side refrigerator-freezer combination 1, without the need to alter the configuration of refrigeration cabinet 12 for each intended use. This may be accomplished, as shown in FIGS. 13 and 14, by providing cutouts 60, 62, 64 for both entry 38 and discharge 40 ducts on alternate opposed planar surfaces comprising the top and bottom of the refrigeration cabinet 12 prior to the addition of the center wall and the vertical panels which form the door and the rear walls of the cabinet. This permits a manufacturer to custom design either a left-handed or right-handed freezer compartment, for example, by varying the orientation chosen for refrigeration compartment 12, as required by the customer. The polyurethane foam insulation may be left within cut-outs such as 62, 64 which are not in use in order to prevent refrigerated air from escaping therefrom.

FIG. 14 illustrates a plan view of the base of refrigerator 1 as viewed from the outside of the cabinet, whereas, in the interior of cabinet 12, a plate member would be utilized to cover cut-outs 64 so as to preserve the esthetic appearance of the interior of the unit.

While it is apparent that the invention herein disclosed is well calculated to fulfill the objects above stated, it will be appreciated that numerous modifications may be devised by those skilled in the art, and it is intended that the appended claims cover all such modifications and embodiments as fall within the true spirit and scope of the present invention.

I claim:

1. A power module for cooling a refrigeration cabinet which comprises:

a first compartment substantially surrounded by thermally insulated barrier means and communicating with an inner portion of said refrigeration cabinet, containing:

(i) evaporator means;

(ii) means for circulating refrigerated air past said evaporator means so as to be in contact therewith and thereafter into an inner portion of said refrigeration cabinet for cooling said cabinet, said air thereafter returning to said module for recycling, wherein motor means for said refrigerated air circulating means is located in a second compartment, substantially separated from said first compartment by said thermally insulated barrier means;

(iii) defroster heater means adjacent said evaporator means for supplying thermal energy to melt frost from said evaporator means during a defrosting cycle;

(iv) temperature sensing means for determining the ambient temperature within said first compartment and thereby controlling the duration of the defrosting cycle; and (v) means for collecting and exhausting the melted frost from said first compartment into said second compartment wherein said collection and exhaustion means is dimensioned and configured to prevent a flow of warm air from entering said first compartment through said collection and exhaustion means from said second compartment;

said second compartment containing:

(i) compressor means for compressing a refrigerant;

(ii) condensor means for receiving and cooling said refrigerant;

(iii) means for directing said refrigerant from said compressor means to said condensor means;

(iv) means within said second compartment for circulating ambient room air first past said condensor means so as to be in contact therewith for removing heat therefrom and facilitating the condensation of said refrigerant, then past said compressor means and out of said second compartment, said second compartment being separated from said first compartment by an insulated wall dimensioned and configured to minimize the surface area of said insulated wall portion separating said first and second compartments, and contacted by the now warmed air circulated by said ambient air circulating means to thereby minimize heat transfer to said second compartment;

(v) means for directing said cooled refrigerant from said condensor means to said evaporator means at a predetermined temperature and pressure whereby said refrigerant is permitted to expand within said evaporator means so as to absorb heat from said air directed by said refrigerated air circulating means across an outer surface of said evaporator means; and (vi) means for returning said refrigerant from said evaporator means to said compressor means.

2. The power module of claim 1 wherein said barrier means is thermally insulated with polyurethane foam.

3. The power module of claim 1 wherein said refrigerant is dichlorodifluoromethane.

4. The power module of claim 1 wherein the commencement of said defrosting cycle is regulated by timer means.

5. The power module of claim 1 wherein said refrigerated air and ambient room air circulating means comprises fan means powered by motor means.

6. The power module of claim 1 wherein said temperature sensing means is a thermostat.

7. The power module of claim 1 wherein said means for directing said refrigerant from said condenser means to said evaporator means at a predetermined pressure is a capillary tube.

8. The power module of claim 1 wherein said means for collecting and exhausting said melted frost is a U-shaped conduit, partially filled with water contain a ball member therein.

9. The power module of claim 1 wherein said means for collecting and exhausting said melted frost is an elongated cylindrical conduit having an enlarged central bore which houses a ball member therein.

10. A forced circulating air refrigeration apparatus which comprises:

a first section having a width of about 17 inches, comprising a substantially vertically standing refrigeration cabinet, constructed of a top member, a bottom member and two pairs of opposed vertical side members and having means for access to an interior portion on at least one vertical side; and a modular cooling compartment also having a width of about 17 inches, and comprising the improved power module of claim 1 for cooling the interior portion of said first section.

11. The refrigeration apparatus of claim 10 wherein said first section is separated into an upper freezer section and a lower refrigerator section by divider means.

12. The refrigeration apparatus of claim 11 wherein said divider means is a removable shelf.

13. A forced circulating air refrigeration apparatus which comprises:

a first compartment including a central wall dividing said first compartment into a freezer section and a refrigerator section, the central wall having a first opening to permit the circulation of chilled air from the freezer section to the refrigerator section and a second opening to permit the return circulation of chilled air from the refrigerator section to the freezer section;

a second compartment adjacent said first compartment, said second compartment being subdivided into a cool section communicating with an inner portion of said first compartment, and a warm section, said sections being separated from one another by thermally insulating barrier means;

wherein said cool section contains:

(i) evaporator means;

(ii) means for circulating refrigerated air past said evaporator means and in contact therewith and thereafter into an inner portion of said first compartment for cooling said first compartment, said air thereafter returning to said cool section of said second compartment; wherein motor means for said refrigerated air circulating means is located in said warm section;

(iii) a defroster heater adjacent to said evaporator means for supplying thermal energy to melt frost from said evaporator means during a defrosting cycle;

(iv) temperature sensing means for determining the ambient temperature within said cool section thereby controlling the duration of said defrosting cycle; and (v) means for collecting and exhausting said melted frost from said cool section through said thermally insulated barrier means, into said warm section wherein said collected and exhausted means is dimensioned and configured to prevent a flow of warm air from entering said cool section through said collection and exhaustion means from said warm section; and said warm section contains:

(i) compressor means for compressing a refrigerant;

(ii) condensor means for receiving and cooling said refrigerant;

(iii) means for directing said refrigerant from said compressor means to said condenser means;

(iv) means for circulating ambient room air first past said condensor means so as to be in contact therewith for removing heat therefrom and facilitating the condensation of said refrigerant, then past said compressor means and out of said warm section, said warm section being separated from said cool section by an insulated wall dimensioned and configured to minimize the surface area of said insulating wall portion separating said warm and cool section contacted by the now warmed air circulated by said ambient air circulating means;

(v) means for directing said cooled refrigerant from said condensor means to said evaporator means at a predetermined temperature and pressure whereby said refrigerant is permitted to expand within said evaporator means so as to absorb heat from said air directed by said refrigerated air circulating means across an outer surface of said evaporator means; and (vi) means for returning said refrigerant from said evaporator means to said compressor means.

14. The refrigeration apparatus of claim 13 wherein said first and second compartments are of modular construction and are separable from one another.

15. The refrigeration apparatus of claim 13 wherein said barrier means is thermally insulated with polyurethane foam.

16. A method for improving the cooling efficiency of a power module for use in communication with a forced circulating air refrigeration cabinet, wherein said power module comprises:

(i) a warm compartment;

(ii) a cool compartment separated from said warm compartment by thermally insulated barrier means;

(iii) first motor driven means for circulating air throughout said refrigeration cabinet, said means being located in said cool compartment;

(iv) means connecting said warm and said cool compartments for removal of melted frost; and (v) second motor driven means for circulating air through said warm component to evaporate said melted frost;

which method comprises:

(i) locating said first and said second motor drive means of said calculating air means in the warm compartment on the outer surface of said thermally insulated barrier means;

(ii) configuring said connecting means to prevent the movement of warm air from said warm compartment to said cool compartment; and (iii) directing said circulating air first past condenser means located in said warm component for removing heat therefrom and facilitating the condensation of refrigerant, then past compressor means located in said warm compartment and thereafter out of said warm compartment, said warm and cool compartments separated by said thermally insulated barrier means so as to minimize the surface area of said thermally insulated barrier means contacted by said warm air to promote more efficient cooling in said cool compartment while minimizing the energy required to obtain said cooling.

17. A method for constructing a power module for cooling a substantially vertically standing refrigeration cabinet which comprises a top member, a bottom member and two pairs of opposed vertical side members, said refrigeration cabinet having a means for access to an interior portion of said cabinet on at least one vertical side member, said method comprising:

(i) locating a first compartment substantially rearwardly upon said top member of said refrigeration cabinet with respect to an access means;

(ii) locating a second compartment substantially forwardly upon said top member to said refrigeration cabinet with respect to said access means;

(iii) thermally separating said first compartment from said second compartment by thermal barrier means;

(iii) isolating first drive means and second drive means for said refrigerated air and ambient air circulation means respectively on the outer surface of said thermally insulated barrier means in said second compartment;

(iv) configuring collection and exhaustion means so as to prevent the flow of warm air from said second compartment, through said collection and exhausting means into said first compartment; and (v) directing and circulating air in said second compartment so as to minimize contact with the outer insulated portion of said first compartment.

18. The power module produced by the process of claim 17.

19. A method for constructing a forced circulating air refrigeration apparatus which comprises:

constructing a first compartment comprising a substantially vertically standing refrigeration cabinet having a top member, a bottom member and two pairs of opposed vertical side members, said refrigeration cabinet having means for access to an interior portion of said cabinet on at least one vertical side member; said cabinet further including a central wall dividing said first compartment into a freeze section and a refrigerator section, the central wall having a first opening to permit the circulation of chilled air from the refrigerator section to the freezer section;

constructing a second compartment adjacent said first compartment, said second compartment being subdivided into a cool section located substantially rearwardly upon said top member of said refrigeration compartment with respect to said access means; and a warm section located substantially fowardly upon said top member of said refrigeration cabinet with respect to said access means, said warm section and said cool section being separated from one another by thermally insulated barrier means;

isolating first drive means and second drive means for said refrigerated air and ambient air circulation means respectively on the outer surface of said thermally insulated barrier means in said warm section;

configuring said collection and exhaustion means so as to prevent the flow of warm air from said warm section through said collection and exhaustion means into said cool section; and including means for directing and circulating the air in the warm section first past condensor means located in said warm section for removing heat therefrom and facilitating the condensation of refrigerant, then past compressor means located in said warm section and thereafter into said cool section so as to minimize the surface area of said thermally insulated barrier means contacted by said warm air to promote more efficient cooling in said cool section while minimizing the energy required to obtain such cooling.

20. The forced circulating air refrigeration apparatus produced by the process of claim 19.

21. A power module for cooling a refrigeration cabinet which comprises:

a first compartment substantially surrounded by thermally insulated barrier means and communicating with an inner portion of said refrigeration cabinet, containing:

(i) evaporator means;

(ii) means for circulating refrigerated air past said evaporator means so as to be in contact therewith and thereafter into an inner portion of said refrigeration cabinet for cooling said cabinet, said air thereafter returning to said module for recycling;

(iii) defroster heater means adjacent said evaporator means for supplying thermal energy to melt frost from said evaporator means during a defrosting cycle;

(iv) sensing means for determining the ambient temperature within said first compartment to control the duration of the defrosting cycle; and (v) means for collecting and exhausting said melted frost from said first compartment into said second compartment wherein said collection and exhaustion means is dimensioned and configured to prevent a flow of warm air from entering said first compartment through said collection and exhaustion means from said second compartment;

said second compartment containing:

(i) compressor means for compressing a refrigerant;

(ii) condensor means for receiving and cooling said refrigerant;

(iii) means for directing said refrigerant from said compressor means to said condensor means;

(iv) means for circulating ambient room air first past said condensor means so as to be in contact therewith for removing heat therefrom and facilitating the condensation of said refrigerant, then past said compressor means and out of said second compartment, said second compartment being separated from said first compartment by an insulated wall dimensioned and configured to minimize the surface area of said insulated wall portion separating said first and second compartments, and contacted by the now warmed air circulated by said ambient air circulating means to thereby minimize heat transfer to said second compartment;

(v) means for directing said cooled refrigerant from said condensor means to said evaporator means at a predetermined temperature and pressure whereby said refrigerant is permitted to expand within said evaporator means so as to absorb heat from said air directed by said refrigerated air circulating means across an outer surface of said evaporator means; and (vi) means for returning said refrigerant from said evaporator means to said compressor means.

22. The power module according to claim 21 wherein said means for circulating refrigerated air passed said evaporator means comprises a fan suitably arranged to circulate refrigerated air passed said evaporator means so as to be in contact therewith and thereafter into an inner portion of said refrigeration cabinet for cooling said cabinet.

23. The power module according to claim 22 wherein said fan means is operatively rotated by propulsion means located in said second compartment, substantially separated from said first compartment by said insulated wall so as to be thermally insulated therefrom.

24. The power module according to claim 1 wherein the air in said second compartment is directed past said motor means for said refrigerated air circulating means prior to being circulated past said compressor means.

25. The forced circulating air refrigerator apparatus according to claim 13 wherein the air in said warm section is directed past said motor means for said refrigerated air circulating means prior to being circulated past said compressor means.

* * * * *